US005752548A

United States Patent [19]

Matsumoto et al.

[11] Patent Number: 5,752,548

[45] Date of Patent: May 19, 1998

[54] COUPLING FOR DRAINAGE PIPINGS

[75] Inventors: Shigeyuki Matsumoto; Shinobu Katoh; Keisuke Sugawara; Masao Kanazawa; Yutaka Yoshida, all of Tokyo, Japan

[73] Assignee: Benkan Corporation, Tokyo, Japan

[21] Appl. No.: 709,602

[22] Filed: Sep. 9, 1996

[30] Foreign Application Priority Data

Oct. 6, 1995 [JP] Japan ..... 7-286558

[51] Int. Cl.[6] ..... F15D 1/04

[52] U.S. Cl. ..... 138/39

[58] Field of Search ..... 138/42, 44, 39, 138/37; 285/179, 120.1, 125.1, 131.1, 132.1, 133.11

[56] References Cited

U.S. PATENT DOCUMENTS

| | | | |
|---|---|---|---|
| 630,605 | 8/1899 | Gordon | 138/39 |
| 1,778,790 | 10/1930 | Brandl et al. | 138/37 X |
| 2,246,871 | 6/1941 | Balch | 138/37 X |
| 2,280,195 | 4/1942 | Long | 138/37 X |
| 2,566,654 | 9/1951 | Collison et al. | 138/39 |

FOREIGN PATENT DOCUMENTS

| | | | |
|---|---|---|---|
| 431640 | 7/1935 | United Kingdom | 138/37 |

*Primary Examiner*—Paul C. Lewis

*Attorney, Agent, or Firm*—Eric P. Schellin

[57] ABSTRACT

A coupling for vertical connection in sewage plumbing used in tall and high-rise buildings, is disclosed. The coupling is equipped in its inside walls with a pair of vortical blades for descending sewage streams from the upper floors into the coupling to impinge on their top blade surface to flow sideways into a spiral flow down the coupling. The more intense vortex streams developed, the faster the streams fall along the plumbing. For a vortex generates a vertical column of upwardly moving ventilative air in the center of the sewage streams, smoothing the descent of the drainage. Moreover, the top and bottom blades are mounted at different levels of height inside the coupling, and circumferentially displaced to each other so as to form a V-shape as seen in the horizonal projection view.

The positional displacement is designed such that the bottom vortex blade can capture on its surface essentially all of the streams captured by the top vortical blade, thereby duplicating the vortical motion of the falling streams from the top blade.

2 Claims, 4 Drawing Sheets

COUPLING FOR DRAINAGE PIPINGS

BACKGROUND OF THE INVENTION

1) Field of the Invention

This invention relates in general to a coupling for vertical drain pipings as primarily used in tall buildings and high rises, and particularly to such a coupling equipped along its inside walls with blades to help the flushing drainage take a fast descend in vortex down the plumbing.

2) Description of the Prior Art

A variety of couplings have been developed for drainage plumbing systems used in high-rise office and residential buildings, which are designed to eliminate possible drainage problems, such as a backed-up toilet or a slow draining sink. These problems can cause inconvenience not only to the floor with a defective piping system, but also to a large number of tenants in the same building.

The Prior Art disclosed in Japanese laid-open patent application 95-58,480 can be taken as a typical example of conventional art, as shown in FIGS. 5 and 6. With respect to the drawings, a coupling 1 comprises an upper tapered portion 2, a side inlet port 3 provided below the upper tapered portion, a bulged central portion 4 and a lower tapered portion 5.

The side inlet port 3 permits the connection of a horizontal branch pipe which conducts sewage into the plumbing through the coupling 1. An upstream drain pipe 6 is linked at an upper end thereof to the coupling 1 which is connected at a lower end to a downstream drain pipe 8, so that the sewage down the upstream pipe 6 flows through the coupling into the lower pipe then to the associated plumbing system.

A vortical blade 7 is mounted inside the taper portion 5 of the piping 1, and provided to cause falling flows of sewage from the upstream pipe 6, in conjunction with the sloped walls of the lowered tapered portion 5.

A guide blade 10 is mounted in the coupling 1 just above the upper tapered portion 2, and provided to deflect streams of descending drainage from the upstream pipe 6 into a spiral flow along the inclined walls of the upper tapered portion 2, in conjunction with a half sleeve 9 that is mounted to extend from the base of the upper tapered portion 2.

The upper guide blade 10 is mounted at a location opposite to the lower vortical blade 7, so as to take more falling streams of sewage on its upper surface and lead their spiral drop down the coupling 1. The spiral flow thus induced in descending sewage streams by the guide plates 10 and vortical blades 7 will continue to be maintained in the downstream pipe 8, so that the sewage will smoothly drain through the plumbing system.

Another prior art coupling 1', as illustrated in FIGS. 7 and 8, is disclosed in Japanese laid-open patent application 95-49,567, which comprises an intake port 11 for connection to a horizontal branch pipe and a pair of upper and lower vortical blades 12 and 12' mounted on either side of the intake port. The paired blades 12 and 12, are located inside the inside walls of the coupling 1' at locations opposite to each other. Their is no bulge in the coupling body as in the earlier disclosure.

The paired blades 12, 12' are substantially intended for causing falling sewage to develop a vortical flow for effective drain down the plumbing.

However, these conventional couplings have been found to pose various difficulties in production and use.

The coupling depicted in FIGS. 5 and 6, for instance, generates design and production problems because of the structural complexity from putting together many components, such as a tapered portion 2 at an upper end of the coupling, bulged portion 4 with an ingress port 3 for a branch pipe guide blade 7 at the base of the upper tapered portion, vertical blade 10 and guide sleeve 9, and a lower tapered portion 5.

The disclosure illustrated in FIGS. 7 and 8 has been found short of satisfactory performance because the paired vortical blades 12, 12' can not generate a sustained spiral flow in descending sewage streams all way down the plumbing system. In other words, the vortex generated by the blades is not strong enough to hold, soon losing momentum. The drainage begins to fall in straight flows in the plumbing filling the entire cross section of the piping, generating a vacuum at the upstream side of the falling sewage. As a result, the drainage eventually comes to slow down or stall its descent.

SUMMARY OF THE INVENTION

Accordingly, a primary object of the present invention is to provide an improved coupling for drains used in high rise buildings, which is built to promote developing a vortex in falling sewage for efficient draining.

Another object is to provide such a coupling which is made simple in construction, by eliminating the bulged portion of the previously cited prior art, so that production would be easier for manufacturers.

List of Reference Numerals

FIGS. 1, 2

20. Coupling

21. Flared inlet port

22. Flange

23. Inlet port for branched pipe

24. Top vortical blade

25. Bottom vortical blade

FIGS. 3, 4

24. Top vortical blade

25. Bottom vortical blade

Figure 1:
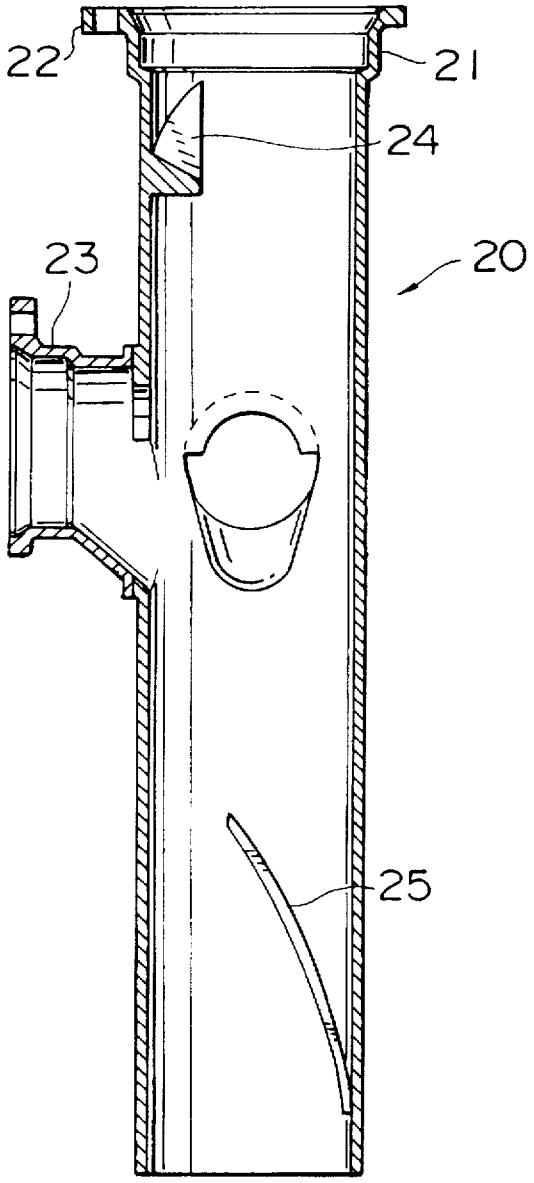
FIG. 1 is a schematic vertical cross-section of the coupling for drains in high-rise buildings according to a first preferred embodiment of the present invention.

A. Trailing edge of top vortical blade

B. Leading edge of bottom vortical blade

C. Trailing edge of bottom vortical blade

E. Imaginary line between points A and B

F. Imaginary vertical line

S. Space defined between top and bottom vertical blade projection

FIGS. 5, 6

1. Coupling

2. Upper tapered portion

3. Inlet port for branched pipe

4. Bulged portion

5. Lower tapered portion

6. Upstream plumbing pipe

7. Lower vortical blade

8. Downstream pluming pipe

9. Guide

10. Upper vortical blade

FIGS. 4, 7, 8

1'. Coupling

11. Inlet port for branched pipe

12. Upper vortical blade

12'. Lower vortical blade

DETAILED DESCRIPTION OF PREFERRED EMBODIMENTS

Preferred embodiments of the coupling for sewage plumbing systems for tall and high-rise buildings built according to the present invention will be described in detail in conjunction with the attached drawings.

Figure 2:
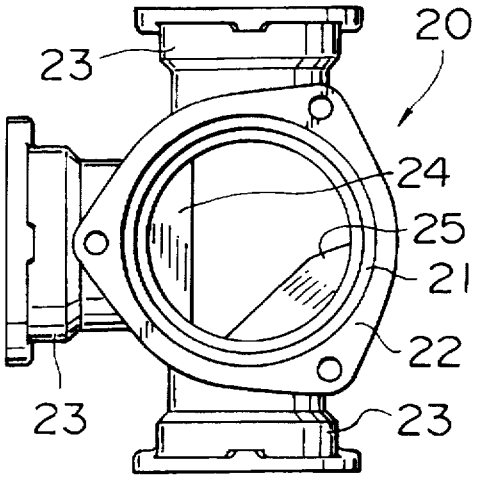
FIG. 2 is a schematic horizontal cross-section of the embodiment of FIG. 1.

With respect first to FIGS. 1 and 2, a coupling 20, which may be of the vertical type with three inlet ports 23 at mid points thereof for linkage to horizontal branch pipes, includes a flange 22 at an upper end thereof the connection to an upstream drain pipe, not shown, with a flared inlet port 21 to facilitate insertion of an lower end of the upstream drain pipe.

The diameter of the coupling 20 can be sized throughout the entire length to be substantially equal with the diameter of the drain pipes connected to upper and lower ends of the coupling.

A top vortical blade 24 is provided inside the walls of the coupling 20, mounted at top end thereof.

Figure 3:
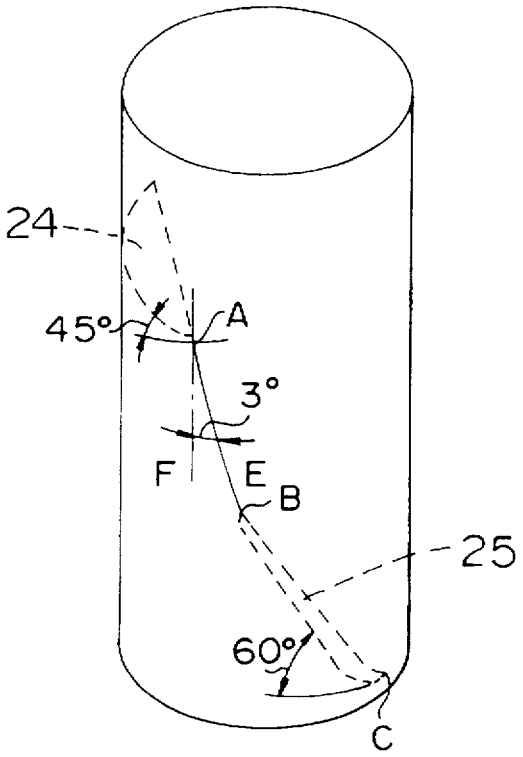
FIG. 3 is a diagram plotted to schematically depict the flow of falling sewage between the upper and lower vortical blades of the coupling according to the embodiment of FIG. 1.

Referring to FIG. 3, the top vortical blade 24 may preferably be tilted to define an angle of 45 degrees between the slanted plane of the blade surface and the horizontal cross-sectional plane of the coupling 20, as measured at point A, or the trailing edge of the blade.

The top vortical blade 24 is provided for streams of falling sewage through the upper drain pipe to impinge upon the upper flat surface of the blade, thereby forcing the caught streams to move sidewise into a spiral flow along the inside walls of the coupling and downstream therefrom in the associated plumbing system. The inclination of the top vortical blade 24 is provided to take on its upper flat surface as more streams of the descending sewage.

A bottom vortical blade 25 is also mounted at a bottom end of the inside walls of the coupling 20, provided for the same purposes as the top vortical blade 24. Likewise with the top blade 24, the bottom blade 25 may preferably be positioned slanted to define an angle of 60 degrees between the tilted plane of the blade flat surface and the horizontal cross-sectional plane of the coupling 20, as measured at point C, or the trailing edge of the blade, as best illustrated in FIG. 3.

Figure 4:
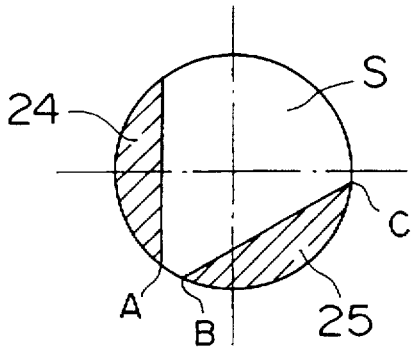
FIG. 4 is a diagram plotted to schematically show the positional relationship between the paired blades as shown in FIG. 3.
Figure 5:
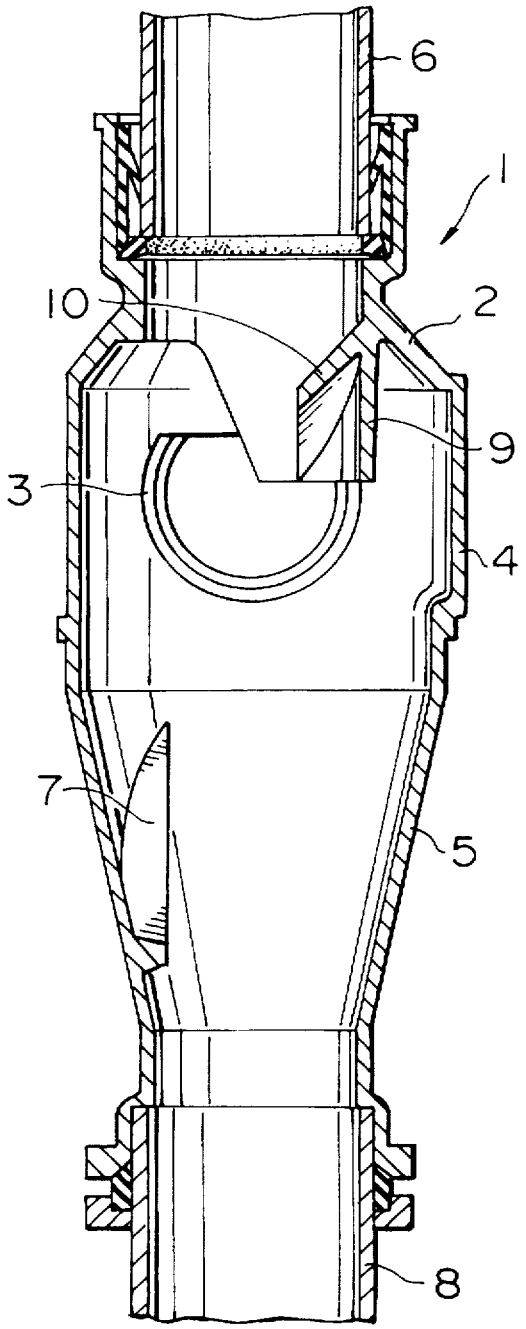
FIG. 5 PRIOR ART
FIG. 5 is a schematic vertical cross-section of a conventional coupling.
Figure 6:
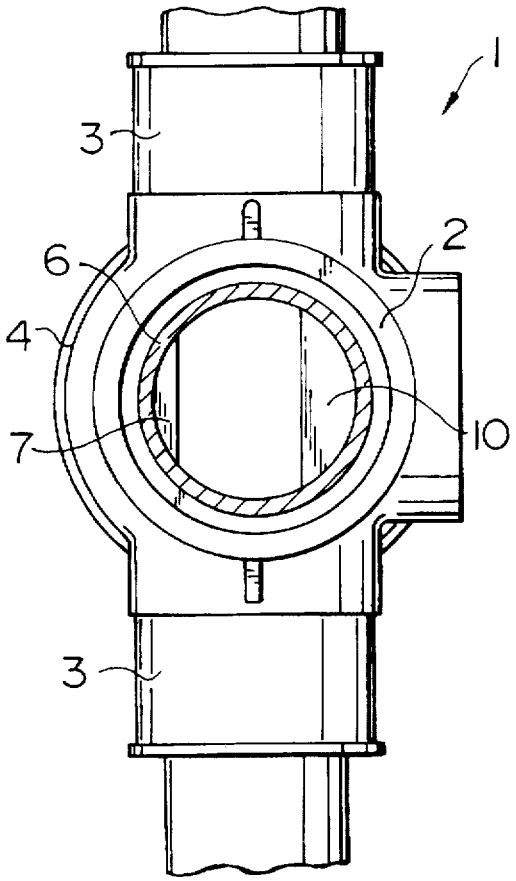
FIG. 6 PRIOR ART
FIG. 6 is a schematic horizontal cross-section of the coupling of FIG. 5.
Figure 7:
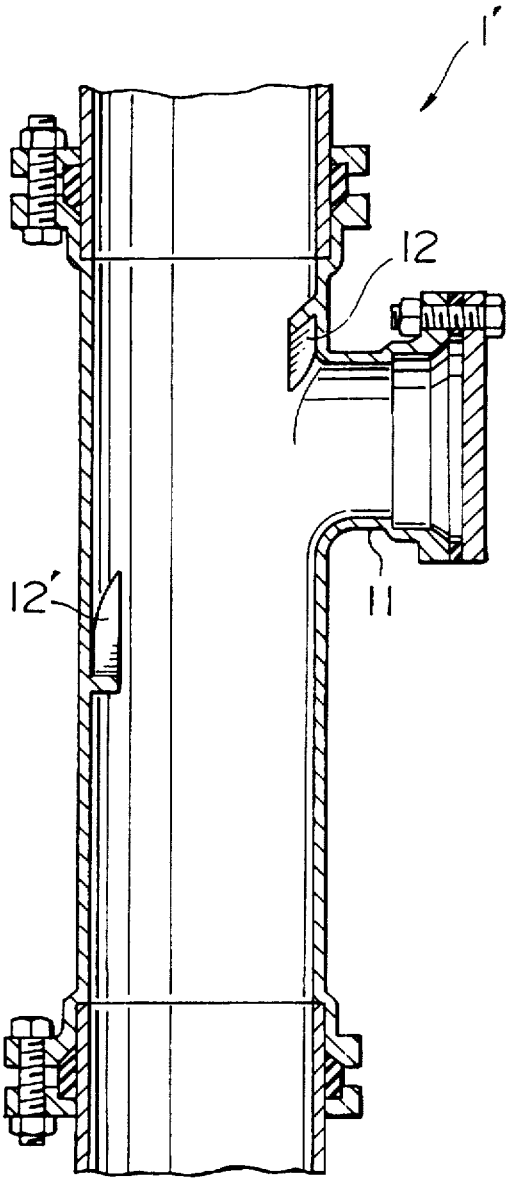
FIG. 7 PRIOR ART
FIG. 7 is a schematic vertical cross-section of another conventional coupling.
Figure 8:
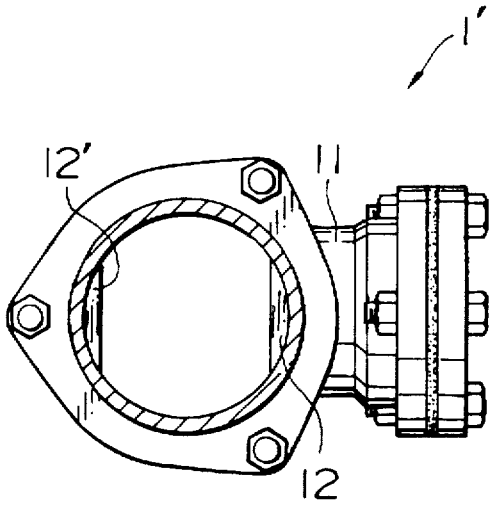
FIG. 8 PRIOR ART
FIG. 8 is a schematic horizontal cross-section of the coupling of FIG. 7.

As can best been shown in FIG. 2 and FIG. 4, the top and bottom vortical blades 24 and 25 are positioned in the inside walls of the coupling 20 at laterally displaced positions to each other, forming a substantially triangular space S defined between the blades in FIG. 4, in which the blades 24, 25 are depicted as shaded projected areas on either side of the space S.

In this particular embodiment, as best shown in FIG. 3, the tilted pair of top and bottom vortical blades 24 and 25 may preferably be mounted in the coupling 20 to form a positional relationship with each other to define an angle of 3 degrees between a vertical imaginary line F, drawn perpendicular with the longitudinal axis of the coupling, and another imaginary line E drawn to connect the trailing edge A of the top tilted top blade 24 with the leading edge B of the sloped bottom blade 25. As a result, the sewage streams that are caught on the sloped flat surface of the top vortex blade 24 are made to move in a direction to impinge on the tilted flat surface of the bottom vortical blade 25. In this sense, the top vortical blade 24 can be said to serve as a guide for the bottom blade 25 in terms of the vortical flow of sewage streams.

This positional configuration of the inclined top and bottom vortical blades 24 and 25 is intended for both blades to receive together as more streams of falling sewage from the top piping of plumbing system to which the coupling 20 is connected, and enhance developing a vortex in falling sewage. In other words, the design is such that the bottom vortical blade 25 will capture on its upper surface most of the sewage streams that escaped impinging on the top vortical blade 24. In addition, the bottom blade duplicates further momentum to the vortex created in sewage streams by the top vortical blade 24.

The more vortex in sewage streams would necessarily develop a ventilative air hole of larger diameter in the axial center of the whirling drain flow. This upwardly flow of ventilative air promotes a faster fall of sewage streams down the plumbing system.

Moreover, the coupling 20 would result in sufficiency of stream velocities reduction therein, thus preventing pressure fluctuation of sewage stream which is present in the plumbing system.

It will be appreciated that it is to allow stabilized falling sewage for draining down the plumbing.

In actual applications, it must be noted that a plurality of couplings 20 should be mounted along the plumbing system, preferably in the same number as the floors of the building, so that the couplings duplicates further momentum to the vortex in sewage streams at a different level of height, thus eliminating a construction of a venting pipes associate with the sewage plumbling.

Ramifications

Features and advantages available from the present invention are such that it will find other applications 30 than mentioned above, such as in fluid carrying systems where liquid streams are caused to fall along vertically standing piping. Therefore, it must be noted that the scope of this invention should cover similar applications to the one described above in respect to FIGS. 5, 6, 7 and 8.

What is claimed is:

1. A throughput coupling for vertical connection in sewage plumbing, wherein the coupling is a substantially vertically extending tubular member having an upper and a side inlet port and a lower outlet port for connection to sewage pipes, comprising a top and bottom vertical blade mounted radially internally in the walls of the coupling and tilted at an angle with respect to a horizonal plane of the coupling, the top and bottom vortical blades being positioned to intercept falling streams of descending sewage in the coupling whereby said streams impinge upon upward facing surfaces of said blades, the top vortical blade being mounted at a top portion of the coupling while the bottom vortical blade being mounted at a bottom portion of the coupling, said blades terminating in edges, said edges of the paired vortical blades being positioned circumferentially and displaced to each other so as to form a largely V-shaped edge in horizontal projection view, the top vortical blade being set in such a positional relationship with the bottom vortical blade so that the bottom vortical blade can capture substantially all of the falling sewage stream that was captured by the top vortical blade in the same coupling, thereby duplicating vortical motion of the falling streams from the top vortical blade.

2. The coupling of claim 1 wherein the top vortical blade being tilted to define an angle of 45 degrees between the slanted plane of the blade of a flat surface and the horizontal projection plane of the coupling at the trailing edge of the top blade, the bottom vortical blade being tilted to define an angle of 60 degrees between a slanted plane of the blade flat surface and the horizontal projection plane of the coupling at the trailing edge of the bottom blade, the pair of top and bottom vortical blades being configured with each other to define an angle of 3 degrees between a vertical imaginary line drawn perpendicular with the longitudinal axis of the coupling, and another imaginary line drawn to connect the trailing edge of the top blade with the leading edge of the bottom blade.

* * * * *